US011474466B2

(12) United States Patent
Nagatomo et al.

(10) Patent No.: US 11,474,466 B2
(45) Date of Patent: Oct. 18, 2022

(54) IMAGE FORMING APPARATUS

(71) Applicant: CANON KABUSHIKI KAISHA, Tokyo (JP)

(72) Inventors: Yuya Nagatomo, Ibaraki (JP); Noriyuki Okada, Chiba (JP); Shozo Aiba, Ibaraki (JP); Naoki Mugita, Ibaraki (JP); Akinori Miyamoto, Ibaraki (JP); Kenta Matsuzaki, Chiba (JP); Masato Maejima, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/524,848

(22) Filed: Nov. 12, 2021

(65) Prior Publication Data

US 2022/0163908 A1 May 26, 2022

(30) Foreign Application Priority Data

Nov. 20, 2020 (JP) ..... JP2020-193759

(51) Int. Cl.
*G03G 15/00* (2006.01)
*G03G 21/00* (2006.01)
(Continued)

(52) U.S. Cl.
CPC ..... *G03G 15/5008* (2013.01); *G03G 21/0011* (2013.01); *G03G 21/0064* (2013.01); *G03G 21/1828* (2013.01); *G03G 15/0131* (2013.01); *G03G 15/0266* (2013.01); *G03G 15/161* (2013.01); *G03G 15/168* (2013.01);
(Continued)

(58) Field of Classification Search
CPC ..... G03G 15/168; G03G 15/0131; G03G 15/0266; G03G 15/161; G03G 15/1675; G03G 15/5008; G03G 15/5045; G03G 21/0011; G03G 21/0064; G03G 21/1828; G03G 2215/1657; G03G 2221/0005; G03G 2221/0089; G03G 2221/1609; G03G 2221/1627
See application file for complete search history.

(56) References Cited

U.S. PATENT DOCUMENTS 8,953,973 B2 2/2015 Aiba et al.
9,098,020 B2 8/2015 Aiba
(Continued)

FOREIGN PATENT DOCUMENTS

JP 2017-044930 A 3/2017
JP 2020-008745 A 1/2020

*Primary Examiner* — Joseph S Wong
(74) *Attorney, Agent, or Firm* — Venable LLP

(57) ABSTRACT

In an image forming apparatus, a cleaning blade, disposed on a downstream side of a transfer roller in a rotation direction of an image carrier, removes toner remaining on the image carrier after transfer of a toner image to an intermediate transfer member. After completion of an image forming operation, a controller causes the transfer roller to separate from the intermediate transfer member, cause the developing device to form on the image carrier a toner band to be supplied to the cleaning blade, and cause rotation of the image carrier to stop such that at least a part of the toner band formed on the image carrier stops within a section from a first position facing the transfer roller to a second position facing the cleaning blade in the rotation direction.

14 Claims, 9 Drawing Sheets

(51) Int. Cl.

| | |
|---|---|
| ***G03G 21/18*** | (2006.01) |
| ***G03G 15/16*** | (2006.01) |
| ***G03G 15/01*** | (2006.01) |
| ***G03G 15/02*** | (2006.01) |

(52) U.S. Cl.
CPC ..... *G03G 15/1675* (2013.01); *G03G 15/5045* (2013.01); *G03G 2215/1657* (2013.01); *G03G 2221/0005* (2013.01); *G03G 2221/0089* (2013.01); *G03G 2221/1609* (2013.01); *G03G 2221/1627* (2013.01)

(56) References Cited

U.S. PATENT DOCUMENTS

| | | | | |
|---|---|---|---|---|
| 9,851,670 | B2 * | 12/2017 | Takeuchi | G03G 15/065 |
| 9,864,306 | B2 | 1/2018 | Ueno et al. | |
| 2012/0008970 | A1 * | 1/2012 | Takenaka | G03G 15/0131 399/66 |
| 2014/0321874 | A1 * | 10/2014 | Sugiura | G03G 21/0035 399/101 |
| 2017/0351200 | A1 | 12/2017 | Matsuzaki | |

* cited by examiner

IMAGE FORMING APPARATUS

BACKGROUND OF THE INVENTION

Field of the Invention

The present invention relates to electrophotographic image forming apparatus.

Description of the Related Art

There are known configurations of an electrophotographic image forming apparatus in which toner is supplied to a cleaning blade for cleaning a photosensitive drum in order to prevent degradation (e.g., peeling, chipping, wear, or the like) of the cleaning blade (Japanese Patent Laid-Open No. 2020-8745 and Japanese Patent Laid-Open No. 2017-44930). The supply of toner reduces the frictional force between the photosensitive drum and the cleaning blade, making it possible to suppress degradation of the cleaning blade.

However, in the above-described prior art, the toner on the photosensitive drum is recovered by the cleaning blade after completion of an image forming operation. Therefore, at the start of the next image forming operation, there may be a time when toner for reducing the frictional force is not supplied between the cleaning blade and the photosensitive drum. Further, when the toner adhering to the photosensitive drum for supply to the cleaning blade passes through a primary transfer nip portion at the start of the next image forming operation, the toner may adhere to a recording material via an intermediate transfer belt, and the recording material may be fouled on the back side.

SUMMARY OF THE INVENTION

Accordingly, the present invention provides a technique that enables a toner band to be supplied to the cleaning blade during a pre-rotation operation (preparation operation) for the next image formation without causing fouling on the back side of the recording material.

According to one aspect of the present invention, there is provided an image forming apparatus, comprising: an image carrier that is driven to rotate; a developing device configured to form, with toner, a toner image by developing an electrostatic latent image formed on the image carrier; an intermediate transfer member to which a toner image that is to be transferred to a recording material is transferred from the image carrier; a transfer roller capable of switching between a state of contact with the intermediate transfer member and a state of separation from the intermediate transfer member, and configured to transfer a toner image on the image carrier to the intermediate transfer member in the state of contact with the intermediate transfer member; a cleaning blade disposed on a downstream side of the transfer roller in a rotation direction in which the image carrier rotates, and configured to remove toner that remains on the image carrier after transfer of a toner image to the intermediate transfer member; and a controller configured to, after completion of an image forming operation for forming an image on a recording material, cause the transfer roller to separate from the intermediate transfer member, cause the developing device to form on the image carrier a toner band to be supplied to the cleaning blade, and cause rotation of the image carrier to stop such that at least a part of the toner band formed on the image carrier stops within a section from a first position facing the transfer roller to a second position facing the cleaning blade in the rotation direction.

Further features of the present invention will become apparent from the following description of exemplary embodiments (with reference to the attached drawings).

DESCRIPTION OF THE EMBODIMENTS

Figure 1:
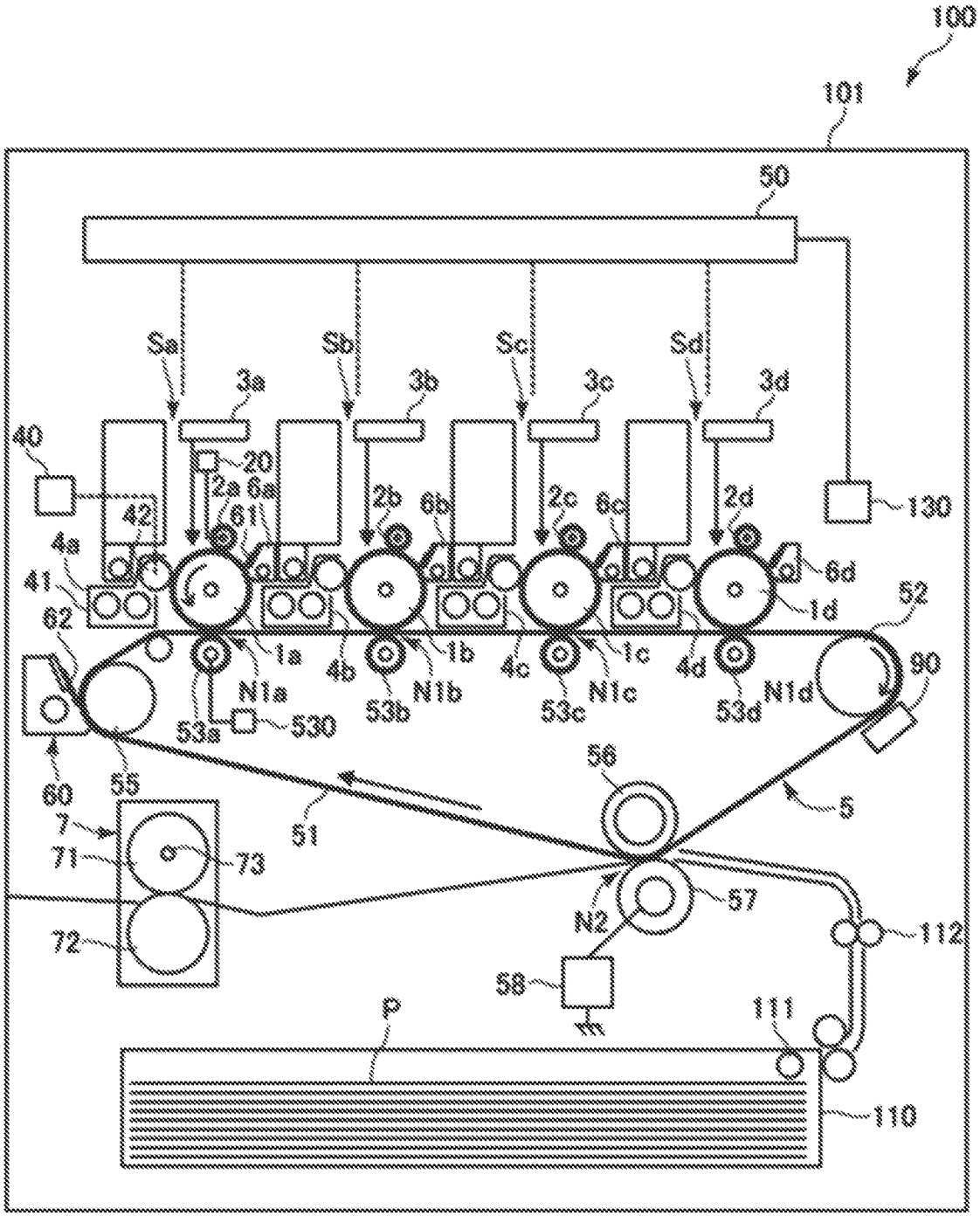
FIG. 1 is a cross-sectional view illustrating a schematic configuration example of an image forming apparatus.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

[Image Forming Apparatus]

FIG. 1 is a cross-sectional view illustrating a schematic configuration example of an image forming apparatus of the present embodiment. An image forming apparatus 100 illustrated in FIG. 1 is an electrophotographic image forming apparatus capable of forming a full-color image. The image forming apparatus 100 uses a tandem-type intermediate transfer method in which a plurality of image forming stations Sa, Sb, Sc, and Sd (Sa to Sd) having different colors of toner are arranged side by side in the rotation direction of an intermediate transfer belt 51. The image forming stations (process units) Sa to Sd form toner images of yellow, magenta, cyan, and black, respectively. In the present embodiment, the configurations of the image forming stations Sa to Sd are substantially the same except that the colors of the toners used are different. Therefore, in the following, a common configuration will be described using the image forming station Sa as representative. Suffixes b, c, and d indicating the configurations of the respective stations are attached to the configurations of the other image forming stations, and their descriptions are omitted.

The image forming station Sa includes a photosensitive drum (photosensitive element) 1*a*, a charging roller 2*a*, a laser scanner 3*a*, a developing device 4*a*, and a drum cleaner 6*a* which are arranged in this order around the photosensitive drum 1*a* in the rotation direction of the photosensitive drum. Adjacent to the photosensitive drums 1*a* to 1*d* of the respective image forming stations Sa to Sd, an intermediate transfer belt 51 which can move around is disposed. In the present embodiment, the photosensitive drums 1*a* to 1*d* are an example of an image carrier, and the intermediate transfer belt 51 is an example of an intermediate transfer member (rotation body) to which a toner image to be transferred to a recording material is transferred from the image carrier.

The photosensitive drum 1*a* is supported by a frame of a main body of the image forming apparatus 100. The photosensitive drum 1*a* is a cylindrical electrophotographic photoreceptor having a basic configuration of a conductive base of aluminum or the like and a photoconductive layer formed on an outer circumference thereof. The photosensitive drum 1*a* has a central shaft, and is driven to rotate about the shaft at a predetermined speed (process speed) (e.g., 320 mm/sec) by a motor (driving source) in the direction of an arrow shown in FIG. 1. In the present embodiment, the charging polarity of the photosensitive drum 1*a* is negative. The outer diameter of the photosensitive drum 1*a* is, for example, 30 mm.

The charging roller 2*a* (charging apparatus) is disposed above the photosensitive drum 1*a* in FIG. 1, and contacts the surface of the photosensitive drum 1*a* to uniformly charge the surface of the photosensitive drum 1*a* to a predetermined polarity and a predetermined potential. The charging roller 2*a* has a conductive core disposed at its center, a low-resistance conductive layer formed on the outer circumference thereof, and a medium-resistance conductive layer, and is configured in an overall roller shape. The two end portions of the core of the charging roller 2*a* are supported by a bearing member (not shown) and are disposed in parallel to the photosensitive drum 1*a*. Bearing members of these two end portions are biased toward the photosensitive drum 1*a* by a pressing member such as a spring (not shown). By this, the charging roller 2*a* is pressed against the surface of the photosensitive drum 1*a* by a predetermined pressing force, and is driven to rotate along with the rotation of the photosensitive drum 1*a*. A charging bias voltage is applied to the charging roller 2*a* by a charging bias power supply 20. Thereby, the surface of the photosensitive drum 1*a* is uniformly charged. Although not shown in FIG. 1, the charging bias power supply 20 also supplies the charging bias voltage to the charging rollers 2*b* to 2*d* of the image forming stations Sb to Sd.

A laser scanner 3*a* irradiates a laser beam on the downstream side of the charging roller 2 in the rotation direction of the photosensitive drum 1*a*. The laser scanner 3*a* scans the laser beam while turning the laser beam off and on based on image information to expose the photosensitive drum 1*a*. Thus, an electrostatic latent image corresponding to the image information is formed on the photosensitive drum 1*a*. In the present embodiment, the charging rollers 2*a* to 2*d* are examples of charging rollers that charge the surface of the image carrier. Further, the charging bias power supply 20 is an example of a first bias application unit that applies a bias voltage in which an AC voltage is superimposed on a DC voltage to the charging rollers 2*a* to 2*d* when the image forming operation is executed.

The developing device 4*a* is disposed on the downstream side of the exposure position of the laser scanner 3*a* in the rotation direction of the photosensitive drum 1*a*. The developing device 4*a* includes a developing container 41 in which a two-component developer that includes nonmagnetic toner particles (toner) and magnetic carrier particles (carrier) is contained, and a development sleeve 42 supported by the developing container 41. The developer is supplied from a toner container (not shown) containing the developer to the developing container 41 by a toner supply device (not shown). The toner and the carrier are agitated while being conveyed in the developing container 41, whereby the toner is negatively charged and the carrier is positively charged.

The development sleeve 42 rotates while carrying the developer in the developing container 41. A voltage (developing bias voltage) obtained by superimposing an alternating current voltage (AC voltage) on direct current voltage (DC voltage) from the developing bias power supply 40 is applied to the development sleeve 42. When a developing bias voltage is applied to the development sleeve 42, the toner in the developer carried on the development sleeve 42 flies toward the photosensitive drum 1*a*, and the electrostatic latent image on the photosensitive drum 1*a* is visualized (developed) by the toner and becomes a visible image (toner image). Although not shown in FIG. 1, the developing bias power supply 40 also supplies a developing bias voltage to the development sleeve 42 of the image forming stations Sb to Sd. In the present embodiment, the developing devices 4*a* to 4*d* are examples of developing devices that develop the electrostatic latent image formed on the image carrier by the toner to form the toner image. The developing bias power supply 40 is an example of a second bias application unit that applies a bias voltage in which an AC voltage is superimposed on a DC voltage to the developing devices 4*a* to 4*d* (the development sleeve 42) when the image forming operation is executed.

Figure 6A:
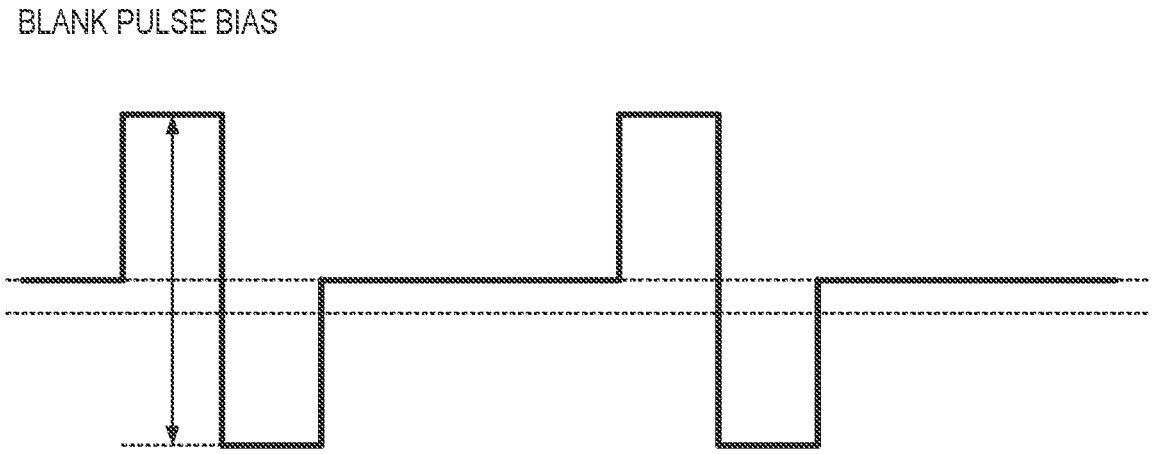
FIGS. 6A and 6B illustrate exemplary developing bias voltages applied to development sleeves.

The developing bias voltage may be composed of a voltage in which an alternating current (AC) component having a predetermined peak-to-peak voltage Vpp is superimposed on a predetermined direct current (DC) component (developing DC voltage). During normal image forming, for example, as a developing bias voltage, a bias voltage as shown in FIG. 6A (hereinafter, referred to as "blank pulse bias") is used. The bias voltage alternately includes a blank portion which is constant at a predetermined DC voltage (e.g., −300 V) and an AC voltage portion which is obtained by superimposing an AC voltage of a rectangular wave having a predetermined frequency (e.g., 10.0 kHz) and a peak-to-peak voltage Vpp (e.g., 1.4 kV) on the DC voltage.

Figure 2:
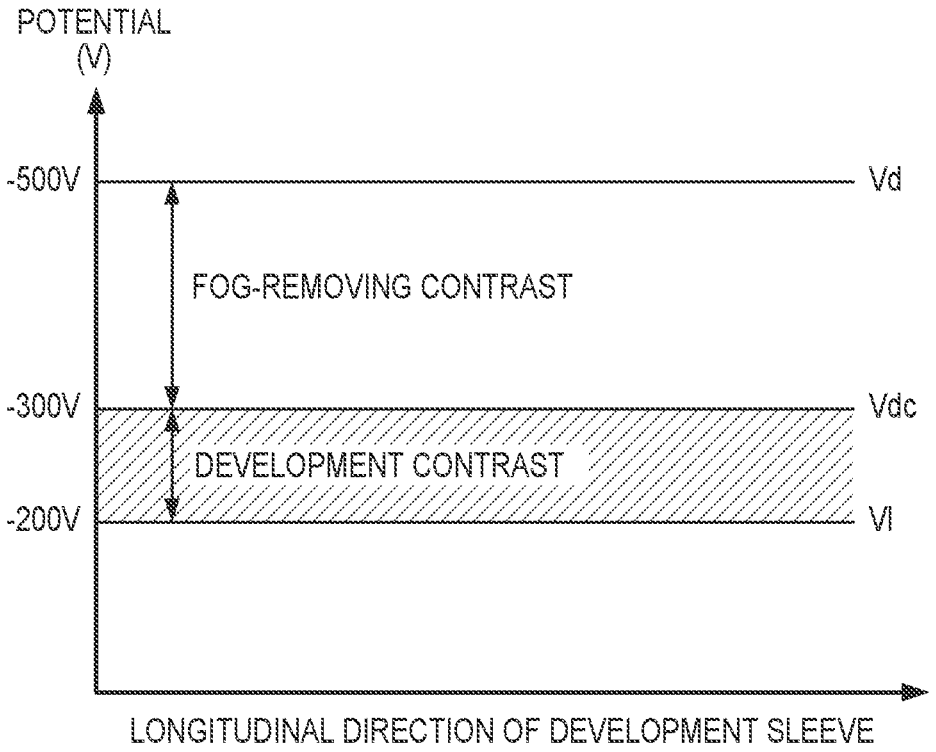
FIG. 2 is an explanatory view illustrating the surface potential of a photosensitive drum at the time of image formation.

FIG. 2 is an explanatory view of the surface potential of the photosensitive drum 1*a* in the rotation axis direction (the longitudinal direction of the development sleeve 42) of the development sleeve 42 at the time of image formation. In FIG. 2, Vd denotes the charged potential (e.g., −500V) of the photosensitive drum 1*a*, Vdc denotes the DC component (e.g., −300 V) of the developing bias voltage, and Vl denotes the potential (e.g., −200V) of the exposed portion exposed by the laser scanner 3*a*. The potential difference between Vdc and Vl is referred to as development contrast. The potential difference between Vd and Vdc is referred to as fog-removing contrast. The fog-removing contrast is such that the toner hardly adheres to portions other than the exposed portions on the photosensitive drum 1*a* (that is, the fog hardly occurs).

As shown in FIG. 2, the electrostatic latent image of the potential Vl is formed by exposing the surface of the photosensitive drum 1*a* charged to the charging potential Vd. After exposure of the photosensitive drum 1*a*, a developing bias voltage having a DC component of Vdc is applied to the development sleeve 42, so that toner charged to the negative polarity adheres to the exposed portion on the photosensitive drum 1*a*. In this way, the electrostatic latent image on the photosensitive drum 1*a* is developed by the toner. In this manner, in the present embodiment, the toner charged to the same polarity as the charging polarity of the photosensitive drum 1*a* is adhered to the exposed portion on the photosensitive drum 1*a*, thereby forming a toner image on the photosensitive drum 1*a*.

An intermediate transfer unit 5 is disposed below the photosensitive drums 1*a* to 1*d* in FIG. 1. The intermediate transfer unit 5 includes the intermediate transfer belt 51, primary transfer rollers 53*a* to 53*d*, a secondary transfer inner roller 56, a secondary transfer outer roller 57, a belt cleaner 60, and the like. The intermediate transfer belt 51 is stretched over a plurality of support members (a driving roller 52, a driven roller 55, and the secondary transfer inner roller 56). The intermediate transfer belt 51 rotates (rotational movement) at a predetermined speed (e.g., 320 mm/sec) in the direction of an arrow in FIG. 1 by the driving force transmitted from the driving roller 52.

Primary transfer rollers 53*a* to 53*d* are disposed at positions facing the photosensitive drums 1*a* to 1*d* on the inner circumferential side of the intermediate transfer belt 51. Since the primary transfer rollers 53*a* to 53*d* have the same configuration, the primary transfer roller 53*a* will be described below as representative. The primary transfer roller 53*a* is constituted by a core and a conductive layer formed in a cylindrical shape on an outer circumferential side thereof. The primary transfer rollers 53*a* to 53*d* are examples of transfer rollers that are capable of switching between a state in which they are in contact with the intermediate transfer member and a state in which they are separated from the intermediate transfer member, and transfer the toner image on the image carrier to the intermediate transfer member in a state in which they are in contact with the intermediate transfer member.

Both ends of the primary transfer roller 53*a* are biased toward the photosensitive drum 1*a* by a pressing member (not shown) such as a spring. Thus, the conductive layer of the primary transfer roller 53*a* is pressed against the surface of the photosensitive drum 1*a* by a predetermined pressing force through the intermediate transfer belt 51. As a result, the photosensitive drums 1*a* to 1*d* and the intermediate transfer belt 51 come into contact with each other to form the primary transfer nip portions N1*a* to N1*d*. The primary transfer rollers 53*a* to 53*d* are in contact with the inner circumferential side of the intermediate transfer belt 51, and are driven to rotate in accordance with the movement of the intermediate transfer belt 51.

The primary transfer rollers 53*a* to 53*d* are capable of switching between a contact state in which they are in contact with the intermediate transfer belt 51 so as to be pressed against the surface of the photosensitive drum 1*a* via the intermediate transfer belt 51 and a non-contact state in which they are not in contact with the intermediate transfer belt 51. The intermediate transfer unit 5 has a driving mechanism (not shown) for switching the primary transfer rollers 53*a* to 53*d* between the contact state and the non-contact state, respectively. This switching is performed in accordance with the operating states of the image forming stations Sa to Sd.

A primary transfer bias power supply 530 is connected to the core of the primary transfer roller 53*a*. At the time of image formation, a primary transfer bias voltage having a polarity (positive polarity in this embodiment) opposite to the charging polarity (negative polarity in this embodiment) of the toner is applied from the primary transfer bias power supply 530 to the primary transfer roller 53. Thus, an electric field is formed between the primary transfer roller 53*a* and the photosensitive drum 1*a* in a direction in which toner having the negative polarity is moved toward the intermediate transfer belt 51 from above the photosensitive drum 1*a*. By the effect of the electric field, the toner image on the photosensitive drum 1*a* is transferred (primary-transfer) onto the surface of the intermediate transfer belt 51.

The drum cleaner 6*a* cleans adhering substances on the surface of the photosensitive drum 1*a* (on the image carrier), such as toner remaining on the photosensitive drum 1*a* after the transfer of the toner image onto the intermediate transfer belt 51. The drum cleaner 6*a* has a cleaning blade 61 that contacts the surface of the photosensitive drum 1*a*. Adhering substances on the photosensitive drum 1*a* are scraped off by the cleaning blade 61. As a material of the cleaning blade 61, a urethane-based material is widely used.

Although not shown in FIG. 1, the image forming station Sa further includes a pre-exposure apparatus (the pre-exposure apparatus 10 of FIG. 4) disposed between the drum cleaner 6*a* and the charging roller 2*a* in the rotation direction of the photosensitive drum 1*a*. In the pre-exposure apparatus, after cleaning by the drum cleaner 6*a* is performed, before the next charging of the photosensitive drum 1*a* by the charging roller 2*a* is performed, the pre-exposure for removing (destaticizing) the electric charges remaining in the photosensitive drum 1*a* is performed in relation to the photosensitive drum 1*a*. The pre-exposure apparatus performs pre-exposure by irradiating the surface of the photosensitive drum 1*a* with light.

A secondary transfer outer roller 57 is disposed at a position facing the secondary transfer inner roller 56 on the outer circumferential surface side of the intermediate transfer belt 51. The secondary transfer outer roller 57 contacts the outer circumferential side of the intermediate transfer belt 51 to form a secondary transfer nip portion N2. The secondary transfer inner roller 56 is electrically grounded, and a secondary transfer bias power supply 58 is connected to the secondary transfer outer roller 57. A secondary transfer bias voltage is applied to the secondary transfer outer roller 57 from the secondary transfer bias power supply 58, whereby the toner image transferred to the intermediate transfer belt 51 is transferred onto the recording material P. Also the secondary transfer inner roller 56 is in contact with the inner circumferential side of the intermediate transfer belt 51, and is rotated in accordance with the movement of the intermediate transfer belt 51.

At the time of image formation, a secondary transfer bias voltage having a polarity (positive polarity) opposite to the charging polarity (negative polarity) of the toner is applied from the secondary transfer bias power supply 58 to the secondary transfer outer roller 57. As a result, an electric field is formed between the secondary transfer inner roller 56 and the secondary transfer outer roller 57 in a direction in which the toner of the negative polarity is moved from the intermediate transfer belt 51 toward the recording material P. By the effect of the electric field, the toner image on the intermediate transfer belt 51 is transferred (secondary transfer) onto the surface of the recording material P.

For example, when a full-color image is formed, toner images of corresponding colors are formed on each of the photosensitive drums 1*a* to 1*d* of each of the image forming stations Sa to Sd, respectively. These toner images are sequentially transferred (primary-transfer) onto the intermediate transfer belt 51 in a superimposed manner. The toner image on the intermediate transfer belt 51 is conveyed to the secondary transfer nip portion N2 along with the rotation of the intermediate transfer belt 51.

The recording material P is conveyed from a cassette 110 to the secondary transfer nip portion N2 when the toner image on the intermediate transfer belt 51 reaches the secondary transfer nip portion N2. Specifically, recording materials P are retrieved from the cassette 110 one by one by a pick-up roller 111 and fed to the conveyance path. Thereafter, the recording material P is conveyed along the conveyance path toward the secondary transfer nip portion N2 by a conveying roller 112 or the like. The recording material is, for example, a sheet material such as a sheet of paper or an OHP sheet. In the secondary transfer nip portion N2, the toner image on the intermediate transfer belt 51 is transferred (secondary transfer) onto the recording material P. The recording material P on which the toner image has been transferred in the secondary transfer nip portion N2 is conveyed to a fixing device 7.

After the secondary transfer is performed, an adhering substance on the outer circumferential side of the intermediate transfer belt 51, such as toner and paper dust remaining on the outer circumferential side of the intermediate transfer belt 51, is cleaned by the belt cleaner 60. The belt cleaner 60 has a cleaning blade 62 that contacts the surface of the intermediate transfer belt 51. Adhering substances on the intermediate transfer belt 51 are scraped off by the cleaning blade 62. As a material of the cleaning blade 62, a urethane-based material is widely used.

The fixing device 7 includes a fixing roller 71 and a pressing roller 72. The pressing roller 72 rotates while applying pressure in contact with the fixing roller 71. Inside the fixing roller 71, a heater 73 such as a halogen lamp is provided. The temperature of the surface of the fixing roller 71 is adjusted by controlling a voltage or the like to be supplied to the heater 73. The recording material P that has been conveyed to the fixing device 7 passes between the fixing roller 71 and the pressing roller 72. At that time, heat and pressure are applied to both surfaces of the recording material P by the fixing roller 71 and the pressing roller 72. Thus, the toner image on the recording material P is melted and fixed to the recording material P, and a full-color image is formed on the recording material P.

Figure 3:
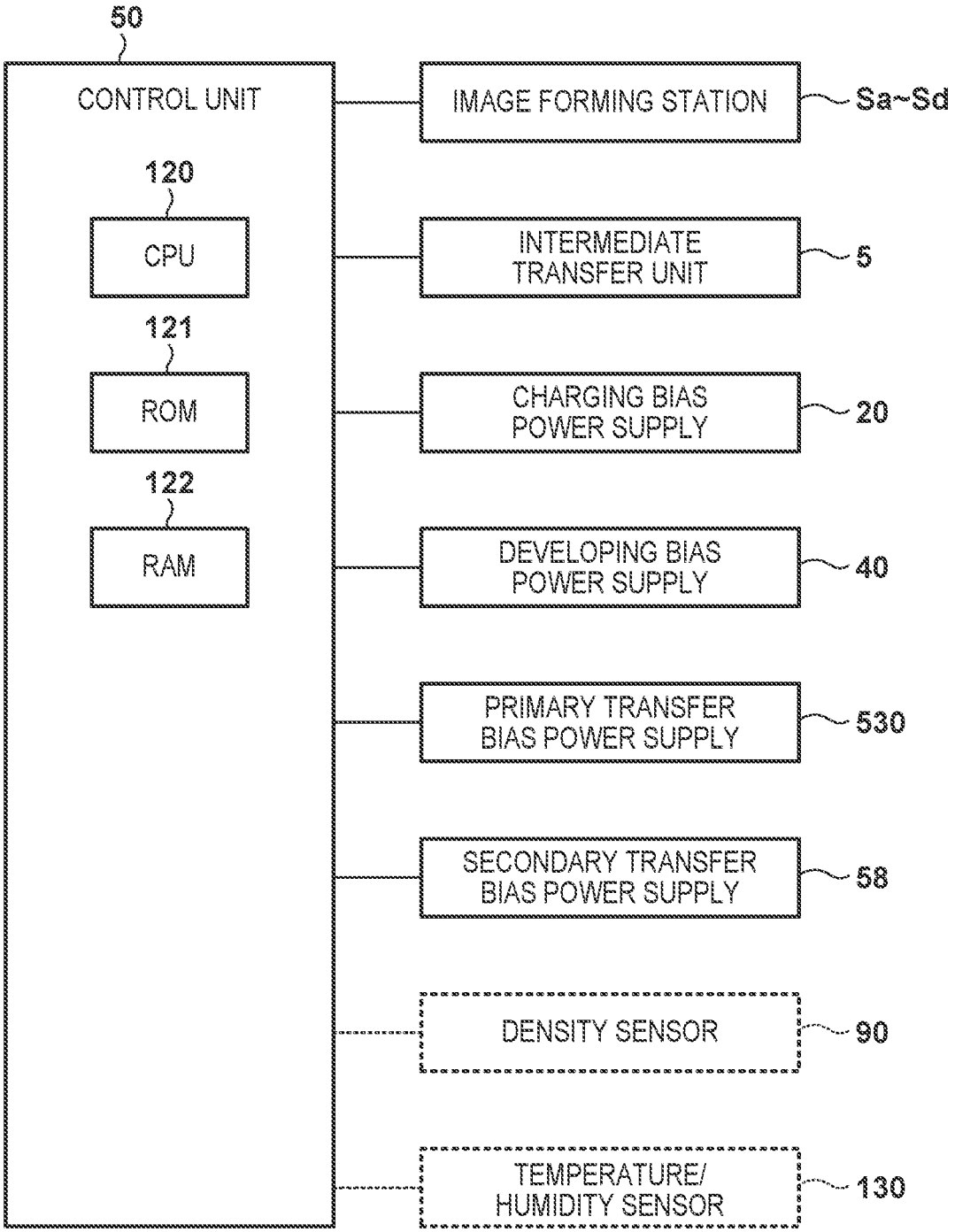
FIG. 3 is a block diagram illustrating a control configuration example of the image forming apparatus.

The image forming apparatus 100 includes a control unit 50 that controls the operation of the entire apparatus. FIG. 3 is a block diagram illustrating a control configuration example of the image forming apparatus 100. The control unit 50 includes a CPU 120. The control unit 50 further includes a RAM 121 and a ROM 122 as storage devices. As shown in FIG. 3, the CPU 120 controls operation of each device in the apparatus, including the image forming stations Sa to Sd, the intermediate transfer unit 5, the charging bias power supply 20, the developing bias power supply 40, the primary transfer bias power supply 530, and the secondary transfer bias power supply 58. The CPU 120 controls operation of the devices based on a control program and settings stored in the RAM 121 or the ROM 122.

The image forming apparatus 100 may include a density sensor 90 for detecting the density of the toner image on the intermediate transfer belt 51. The density sensor 90 is used in the fourth embodiment. The image forming apparatus 100 may include a temperature/humidity sensor 130 for detecting a temperature and a humidity in an environment in which the apparatus is installed. The temperature/humidity sensor 130 is used in the sixth embodiment. The CPU 120 can acquire output signals of the density sensor 90 and the temperature/humidity sensor 130.

When an image forming operation for forming an image on a recording material P is completed, that is, when an image forming job for forming an image on one or a plurality of recording materials P is completed, the CPU 120 performs a post-rotation operation. The post-rotation operation continues to rotate the photosensitive drums 1*a* to 1*d* and the intermediate transfer belt 51 for a predetermined time for cleaning of the photosensitive drums 1*a* to 1*d* and the intermediate transfer belt 51 and destaticization (pre-exposure) of the photosensitive drums 1*a* to 1*d*.

Prior to the beginning of the post-rotation operation, the CPU 120 stops outputting bias voltage (DC component and AC component) from the charging bias power supply 20, the developing bias power supply 40, and the primary transfer bias power supply 530. Further, the CPU 120 stops the rotational driving of the development sleeve 42. Thus, a phenomenon (fogging) in which the toner in the developing container 41 adheres to the photosensitive drums 1*a* to 1*d* does not occur during execution of the post-rotation operation.

[Formation of Toner Band During Post-Rotation Operation]

Cleaning performance of the drum cleaner 6 (6*a*, 6*b*, 6*c*, 6*d*) is affected by the frictional force between the photosensitive drum 1 (1*a*, 1*b*, 1*c*, 1*d*) and the cleaning blade 61. This frictional force varies according to the amount of toner supplied to the drum cleaner 6.

During a normal image forming operation, after a toner image formed on the photosensitive drum 1 on the basis of the image information (image data) is transferred to the intermediate transfer belt 51, toner remaining on the photosensitive drum 1 is supplied to the drum cleaner 6 (the cleaning blade 61). Thereby, the frictional force between the photosensitive drum 1 and the cleaning blade 61 is reduced.

However, the toner is not supplied to the drum cleaner 6 (the cleaning blade 61) during the pre-rotation operation before the start of the image forming operation (in particular, a period until the rotation driving of the development sleeve 42 is started). The result of this is that the frictional force between the photosensitive drum 1 and the cleaning blade 61 temporarily increases. In particular, when an image forming operation is repeatedly executed according to jobs with small numbers of sheets to be printed, the ratio of the execution time of the pre-rotation operation to the total execution time of the image forming operation becomes larger, and the time over which the aforementioned frictional force increases becomes longer. Further, in a high humidity environment, the increase of the aforementioned frictional force occurs more easily.

An increase in the frictional force between the photosensitive drum 1 and the cleaning blade 61 may result in degradation of the cleaning blade 61 (e.g., peeling, chipping, or wear of the cleaning blade 61). When the cleaning blade 61 degrades, the cleaning performance of the drum cleaner 6 decreases, and the toner on the photosensitive drum 1 may adhere to the charging roller 2 without being collected by the drum cleaner 6. When the toner adheres to the charging roller 2 in this way, charging failure occurs in the photosensitive drum 1. This causes a streak image to occur along the conveying direction of the recording material P.

Figure 4:
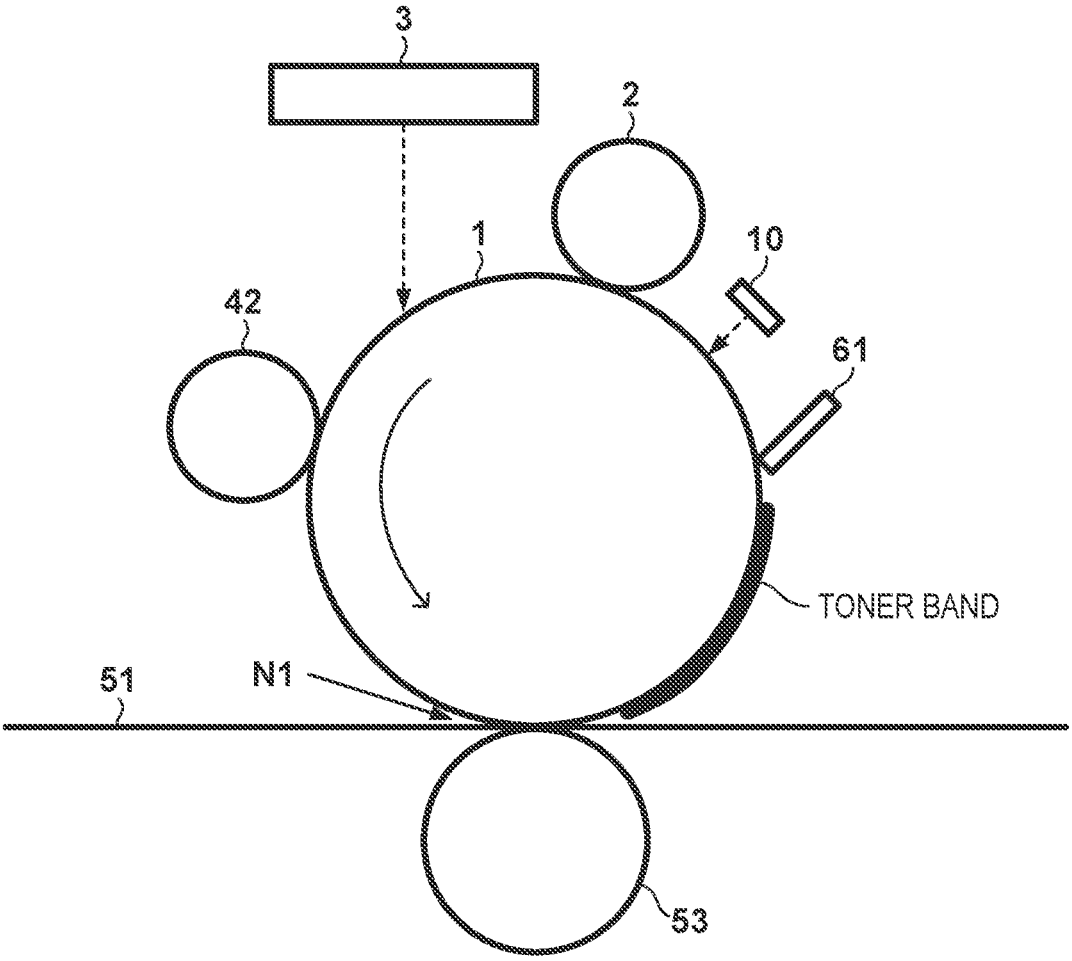
FIG. 4 shows an example of a stop position of a toner band formed on a photosensitive drum.

Therefore, in the present embodiment, in order to suppress the occurrence of a streak image as described above, the image forming apparatus 100 performs the following operation at the time of the post-rotation operation after the end of the image forming operation. Specifically, a toner band is formed on the photosensitive drum 1 in a state (a non-contact state) in which the primary transfer roller 53 (53*a*, 53*b*, 53*c*, and 53*d*) is not in contact with the intermediate transfer belt 51. The toner band is formed by causing toner to adhere to the photosensitive drum 1 across the entirety of the image forming area for example in a direction (also referred to as a main scanning direction or a width direction) perpendicular to the direction (a toner image movement direction) in which the photosensitive drum 1 rotates. That is, the toner band is a toner image formed in a band shape in the rotation direction and the main scanning direction. FIG. 4 shows an example of a stop position of a toner band formed on the photosensitive drum 1. As shown in FIG. 4, the rotation of the photosensitive drum 1 is stopped so that the toner band on the photosensitive drum 1 stops within a section from a position (the first position) facing the primary transfer roller 53 to a position (the second position) facing the cleaning blade 61.

For example, if the above-described toner band is stopped in a section from a position facing the development sleeve 42 to a position facing the primary transfer roller 53, the toner band would be transferred from the photosensitive drum 1 to the intermediate transfer belt 51 during a pre-rotation operation before the start of the next image forming operation. The toner that has moved onto the intermediate transfer belt 51 adheres to the secondary transfer outer roller 57. Thereafter, when the recording material P passes through the secondary transfer nip portion N2, the toner adhering to the secondary transfer outer roller 57 would end up adhering to the back surface of the recording material P, thereby causing the recording material P to be fouled on the back side.

Further, when the above-described toner band formed on the photosensitive drum 1 reaches the position of the drum cleaner 6 (cleaning blade 61) during the post-rotation operation, the toner constituting the toner band is collected by the drum cleaner 6. Therefore, when the rear end of the toner band formed on the photosensitive drum 1 passes through the position of the drum cleaner 6, new toner is not supplied to the drum cleaner 6 (the cleaning blade 61) during the pre-rotation operation before the start of the next image forming operation. As a result, the effect of reducing the frictional force between the photosensitive drum 1 and the cleaning blade 61 cannot be achieved by the toner band formed on the photosensitive drum 1 as described above during the pre-rotation operation.

Therefore, in the present embodiment, as illustrated in FIG. 4, the rotation of the photosensitive drum 1 is stopped so that the toner band formed on the photosensitive drum 1 is stopped at the time of the post-rotation operation within a section from a position facing the primary transfer roller 53 to a position facing the cleaning blade 61. At this time, the rotation of the photosensitive drum 1 is stopped before at least the rear end of the toner band passes through a position facing the cleaning blade 61 after passing through a position facing the primary transfer roller 53. Thus, it is possible to suppress an increase in the frictional force between the photosensitive drum 1 and the cleaning blade 61 during the pre-rotation operation without causing the above-described fouling on the back side in the recording material P at the time of execution of the next image forming operation.

[Operation Sequence]

In the present embodiment, after the image forming operation is completed, the CPU 120 controls the devices in the image forming apparatus 100 so as to perform the following operations. The image forming apparatus 100 forms an image on one or a plurality of recording materials P based on input image data (print job) received from an external apparatus via a network. The CPU 120 performs a pre-rotation operation (preparation operation of the respective devices) at the beginning of the print job. After the pre-rotation operation is performed, the CPU 120 forms an image on the recording material P by the image forming stations Sa to Sd and the intermediate transfer unit 5. After completion of the image forming operation, the CPU 120 executes the post-rotation operation and terminates the execution of the print job.

Figure 5:
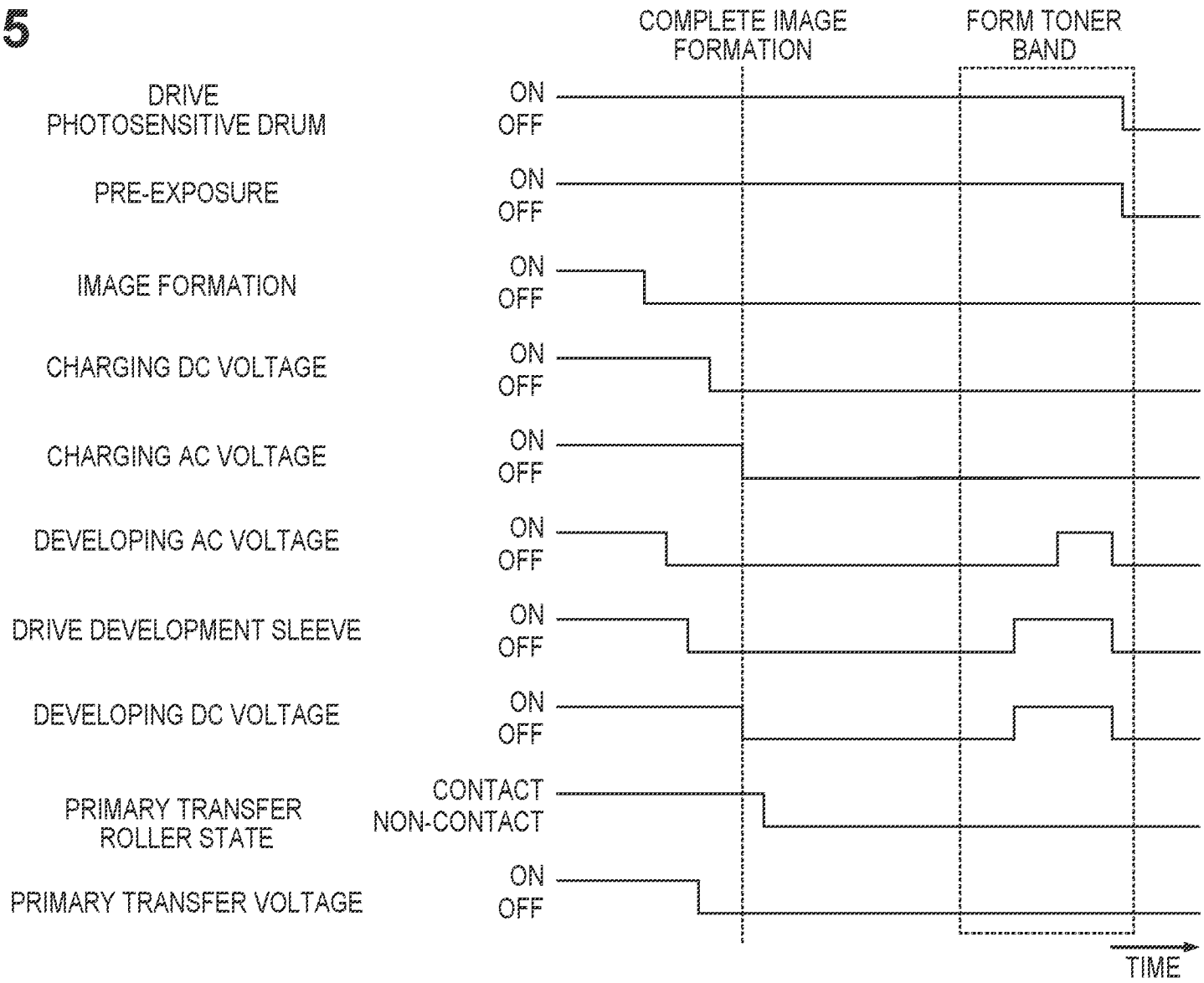
FIG. 5 is a sequence showing timing of operation of each device in a post-rotation operation.

FIG. 5 is a sequence diagram showing timing of operation of each device in a post-rotation operation in the present embodiment. The CPU 120 terminates the application of the developing bias voltage (the developing DC voltage and the developing AC voltage) to the development sleeve 42 by the developing bias power supply 40 when the exposure (image formation) based on the input image data by the laser scanner 3 is completed and the image formation on the recording material P is completed. The CPU 120 further stops the application of the charging bias voltage (the charging DC voltage and the charging AC voltage) to the charging roller 2 by the charging bias power supply 20. Thus, as illustrated in FIG. 5, the charging DC voltage and the charging AC voltage applied to the charging roller 2, and the developing DC voltage and the developing AC voltage applied to the development sleeve 42 are respectively turned from the on state to the off state. Further, the CPU 120 stops the rotation driving of the development sleeve 42 (puts it in the off state) and stops the application of the primary transfer bias voltage to the primary transfer roller 53 by the primary transfer bias power supply 530. By the above operation, the image forming operation is completed.

Thereafter, the CPU 120 executes a post-rotation operation after continuing the rotation of the photosensitive drum 1 and the intermediate transfer belt 51 after the end of the image forming operation for a predetermined time. In the post-rotation operation, the cleaning of the photosensitive drum 1 by the drum cleaner 6, the cleaning of the intermediate transfer belt 51 by the belt cleaner 60, and the pre-exposure of the photosensitive drum 1 by the pre-exposure apparatus 10 are continuously performed. During execution of the post-rotation operation, the CPU 120 continues the rotation driving of the photosensitive drum 1 and the pre-exposure by the pre-exposure apparatus 10 as shown in FIG. 5.

The CPU 120 further performs the following control to form the above-described toner band on the photosensitive drum 1 during the execution of the post-rotation operation. First, the CPU 120 separates the primary transfer roller 53 from the intermediate transfer belt 51, i.e., shifts the belt from the contact state to the non-contact state. This is to prevent the toner band formed on the photosensitive drum 1 from being transferred onto the intermediate transfer belt 51 when passing through the transfer position of the primary transfer roller 53. This makes it possible to prevent the toner band from being transferred onto the intermediate transfer belt 51 and toner adhering to the secondary transfer outer roller 57.

After the separation operation of the primary transfer roller 53 is completed, the CPU 120 turns on the rotational drive of the development sleeve 42 and turns on the application of the developing DC voltage to the development sleeve 42 by the developing bias power supply 40. Thereafter, the CPU 120 turns on the application of the developing AC voltage at a timing at which the rotational drive of the development sleeve 42 and the developing DC voltage applied to the development sleeve 42 are stabilized (for example, at a timing at which 100 ms have elapsed from the start of application of the developing DC voltage). Thus, the formation of the toner band to the photosensitive drum 1 is started. The CPU 120 stops forming the toner band by turning off the application of the developing AC voltage and the developing DC voltage by the developing bias power supply 40 and the driving of the development sleeve 42 at a timing when a predetermined time has elapsed after starting forming the toner band.

The toner band formed at a position facing the development sleeve 42 on the photosensitive drum 1 moves according to the rotation of the photosensitive drum 1. As illustrated in FIG. 4, the CPU 120 stops the rotation of the photosensitive drum 1 so that the toner band on the photosensitive drum 1 stops within a section from a position (the primary transfer nip portion N1) facing the primary transfer roller 53 to a position facing the cleaning blade 61. For example, when the distance from the primary transfer nip portion N1 to the position of the drum cleaner 6 along the rotation direction of the photosensitive drum 1 is 30 mm, and the aforementioned predetermined time is set to 120 ms. Furthermore, the CPU 120 turns off the driving of the photosensitive drum 1 and the intermediate transfer belt 51 and the pre-exposure after a predetermined time (e.g., 120 ms) from the timing when the formation of the toner band is finished (the application of the AC voltage and the developing DC voltage and the driving of the development sleeve 42 are turned off). The predetermined time is predetermined so that the toner band formed on the photosensitive drum 1 stops within a section from a position facing the primary transfer roller 53 to a position facing the cleaning blade 61.

The result of the above-described control, as illustrated in FIG. 4, is that the image forming apparatus 100 stops operation in a state in which a toner band is formed on the photosensitive drum 1 within a section from a position (the primary transfer nip portion N1) facing the primary transfer roller 53 to a position facing the cleaning blade 61. Thus, when the next image forming operation is executed, the toner band on the photosensitive drum 1 is supplied to the drum cleaner 6 (the cleaning blade 61). At this time, since a toner band on the photosensitive drum 1 does not pass through the primary transfer nip portion N1, the recording material P is not fouled on the back side by the toner band. Therefore, it is possible to suppress an increase in the frictional force between the photosensitive drum 1 and the cleaning blade 61 during the pre-rotation operation before the time of the next image forming operation without causing the fouling on the back side of the recording material P.

[Amount of Applied Toner in Toner Band]

In order to suppress the occurrence of the above-described streak image, it is necessary to ensure a certain amount of applied toner in the toner band formed on the photosensitive drum 1. On the other hand, from the viewpoint of economizing the consumption of toner, it can be said that it is desirable that the amount of applied toner of the toner band be as small as possible. In the image forming apparatus 100 of the present embodiment, the development contrast (the potential difference between the surface potential of the photosensitive drum 1 and the developing DC voltage) at the time of the post-rotation operation is set so that the toner band is formed with the amount of applied toner of a predetermined amount or more, while also considering the consumption of toner.

For example, in order to suppress the generation of the above-mentioned streak image in an environment at a temperature of 30° C. and a humidity of 80%, an amount of applied toner of 33 $\mu g/cm^2$ or more is required for a toner band formed the time of post-rotation operation. Also, for example, the development contrast is set to 15V in accordance with an amount of applied toner of 33 $\mu g/cm^2$ or more.

In the present embodiment, the formation of the toner band during the post-rotation operation is performed in a state in which the application of the charging bias voltage to the charging roller 2 is stopped. Therefore, the surface potential of the photosensitive drum 1 becomes a voltage (e.g., −20 V) determined by potential decay caused by the pre-exposure. In this state, a developing bias voltage (developing DC voltage and developing AC voltage) is applied to the development sleeve 42, and the development sleeve 42 is rotationally driven. At this time, the developing DC voltage is set (e.g., −35V) so that a predetermined development contrast (e.g., 15V) can be achieved. As described above, the CPU 120 sets the voltage (developing DC voltage) of the DC component of the developing bias voltage applied to the development sleeve 42 by the developing bias power supply 40 for forming the toner band on the basis of the amount of applied toner required for the toner band. As a result, a toner band is formed on the photosensitive drum 1 with a predetermined amount or more (e.g., 33 $\mu g/cm^2$ or more) of applied toner in accordance with the set development contrast.

Figure 6B:
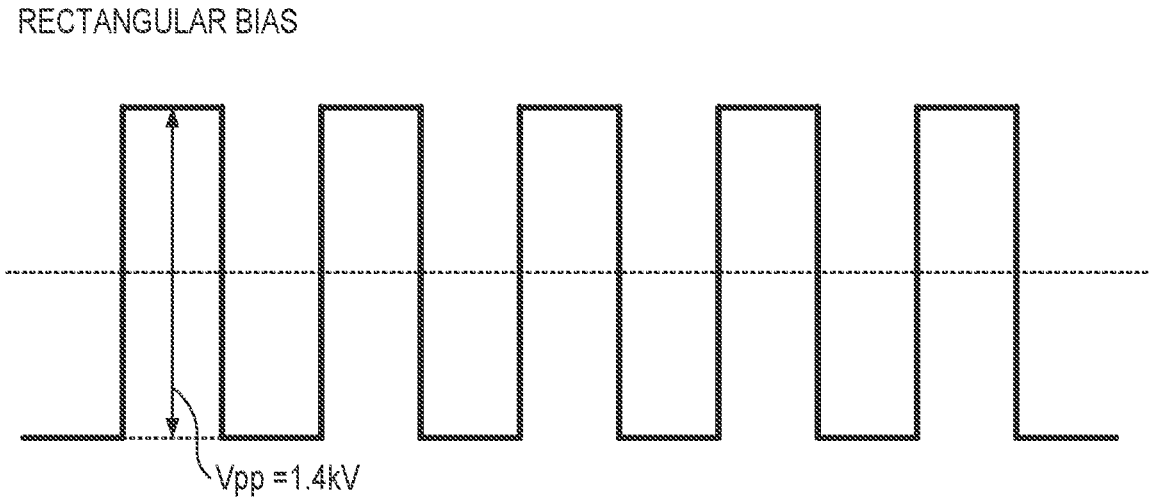

As described above, during normal image forming, a blank pulse bias as shown in FIG. 6A is used as the developing bias voltage. In contrast, during the post-rotation operation, in order to form the toner band, a developing bias voltage (hereinafter, referred to as "rectangular bias") which changes in a rectangular waveform, as shown in FIG. 6B, may be used. In FIG. 6B, a voltage obtained by superimposing an AC voltage of a rectangular wave having a predetermined frequency (e.g., 10.0 kHz) and a peak-to-peak voltage Vpp (e.g., 1.4 kV) on a predetermined DC voltage (e.g., −35V) is shown as a rectangular bias.

Figure 7:
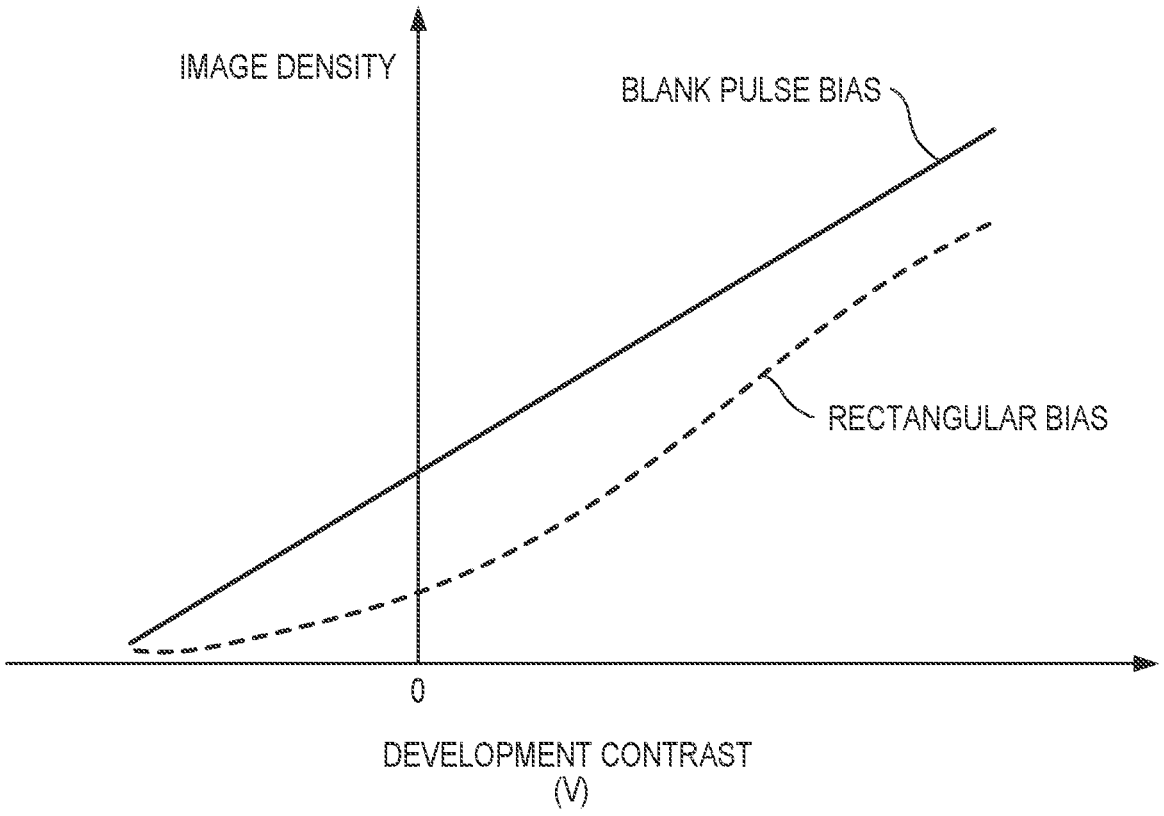
FIG. 7 shows an example of development characteristics by the developing device.

FIG. 7 shows an example of development characteristics of the developing device 4 when the blank pulse bias and the rectangular bias are used, respectively, with the horizontal axis representing development contrast and the vertical axis representing image density. As shown in FIG. 7, when a blank pulse bias is used, a DC voltage is applied to the development sleeve 42 for a long time because a blank portion is provided. Thus, since the toner on the development sleeve 42 easily moves in the photosensitive drum 1*a* direction, stable development of the electrostatic latent image by the toner can be realized.

On the other hand, as shown in FIG. 7, when a rectangular bias is used, since the density of the image (toner image) to be formed becomes lower, it is possible to prevent the density of the toner image from becoming too high. Therefore, by using a rectangular bias for forming the toner band, it is possible to appropriately control the amount of toner applied for the toner band so as to economize toner consumption.

As described above, the image forming apparatus 100 of the present embodiment includes a photosensitive drum 1 (image carrier) which is driven to rotate, a developing device 4 (development sleeve 42), an intermediate transfer belt 51, a primary transfer roller 53, and a drum cleaner 6 (cleaning blade 61). The developing device 4 develops an electrostatic latent image formed on the photosensitive drum 1 to form a toner image with toner. A toner image to be transferred to the recording material P is transferred from the photosensitive drum 1 to the intermediate transfer belt 51. The primary transfer roller 53 is capable of switching between a state in which it is in contact with the intermediate transfer belt 51 and a state in which it is separated from the intermediate transfer belt 51, and transfers the toner image on the photosensitive drum 1 to the intermediate transfer belt 51 in a state in which it is in contact with the intermediate transfer belt. The cleaning blade 61 is disposed on the downstream side of the primary transfer roller 53 in the rotation direction of the photosensitive drum 1, and removes the toner remaining on the photosensitive drum 1 after transfer of the toner image to the intermediate transfer belt 51.

In the image forming apparatus 100 configured as described above, the CPU 120 separates the primary transfer roller 53 from the intermediate transfer belt 51 after the image forming operation for forming an image on the recording material P is completed. Thereafter, the CPU 120 causes the developing device 4 to form a toner band to be supplied to the cleaning blade 61 on the photosensitive drum 1. The CPU 120 stops the rotation of the photosensitive drum 1 so that the toner band formed on the photosensitive drum 1 stops within a section from the first position facing the primary transfer roller 53 to the second position facing the cleaning blade 61 in the rotation direction of the photosensitive drum 1.

By virtue of the present embodiment, it becomes possible to supply toner to the cleaning blade 61 during the pre-rotation operation before the start of the image forming operation (in particular, a period before the start of driving of the development sleeve 42). The result of this is that increases in the frictional force between the photosensitive drum 1 and the cleaning blade 61 can be suppressed. As a result, it is possible to prevent vertical streaks from occurring in the image due to the toner remaining on the photosensitive drum 1 not collected in the drum cleaner 6 adhering to the charging roller 2 during the image forming operation. Further, by virtue of the present embodiment, the toner band formed on the photosensitive drum 1 is not carried to the secondary transfer nip portion N2 during the pre-rotation operation before the start of the image forming operation. Therefore, it is possible to prevent fouling on the back side of the recording material P due to a toner band formed on the photosensitive drum 1 being carried to the secondary transfer nip portion N2. Accordingly, by virtue of the present embodiment, it becomes possible to supply the toner band to the cleaning blade during the pre-rotation operation (preparation operation) for the next image formation without causing fouling on the back side of the recording material P.

Second Embodiment

Next, the second embodiment will be described. In the following, description of portions common to the first embodiment will be omitted, and different portions will be mainly described.

In the first embodiment, the surface potential of the photosensitive drum 1 during the post-rotation operation is determined by potential decay due to pre-exposure. However, the surface potential of the photosensitive drum 1 may vary depending on the use state of the photosensitive drum 1. For example, if the operation state of the image forming apparatus 100 continues and the residual charge in the photosensitive drum 1 increases, the surface potential of the photosensitive drum 1 may not be sufficiently attenuated by pre-exposure. When the toner band is formed in this condition, it is impossible to ensure a predetermined amount of applied toner (e.g., 33 $\mu g/cm^2$) or more with respect to the toner band, and the above-mentioned streak images may occur.

Therefore, in the present embodiment, before the start of formation of the toner band, a charging AC voltage is applied to the charging roller 2 in order to cause the surface potential of the photosensitive drum 1 to converge at a sufficiently low value (e.g., 0V). This realizes the formation of the toner band with a more stable amount of applied toner.

Figure 8:
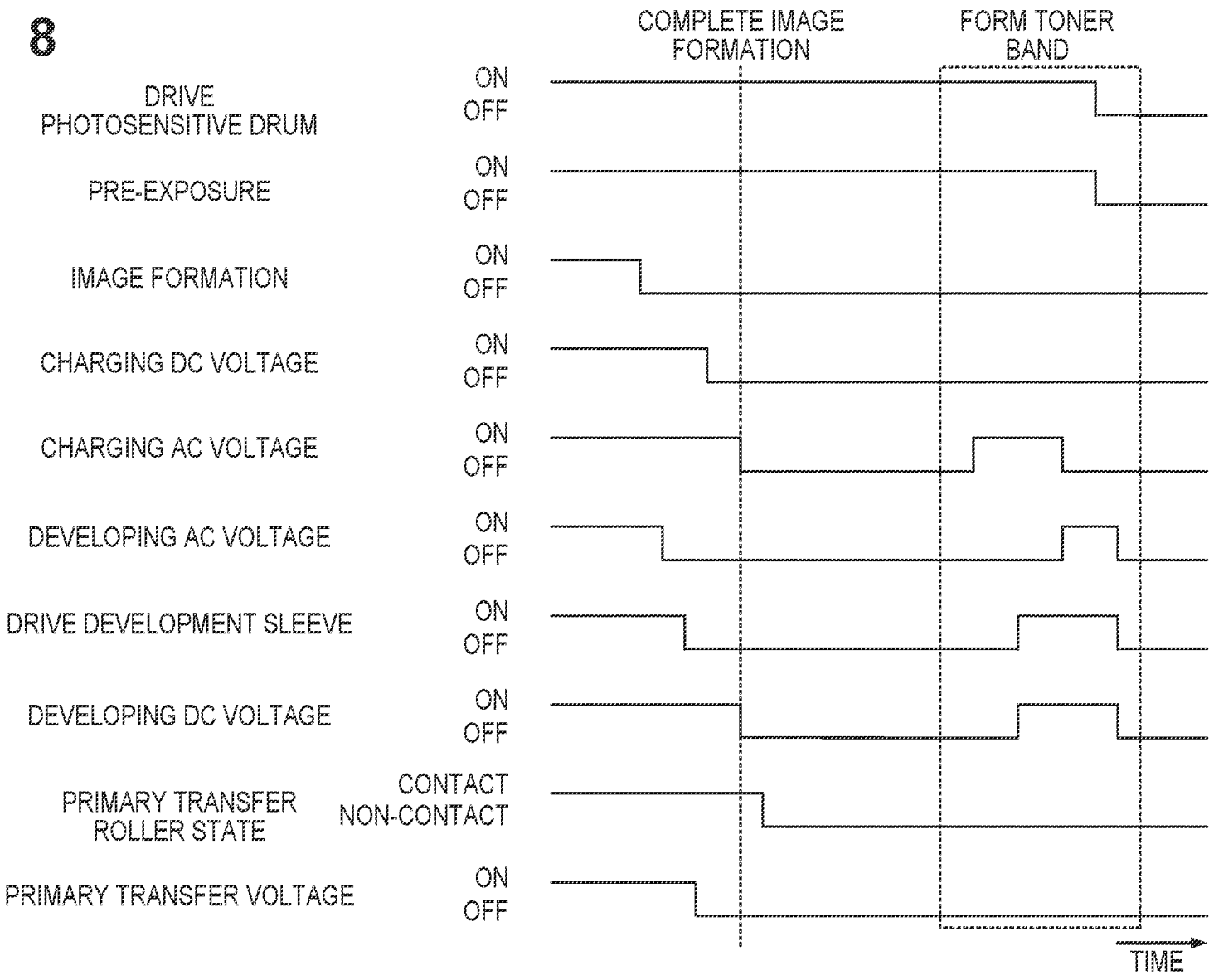
FIG. 8 is a sequence diagram showing timing of operation of each device in a post-rotation operation.

FIG. 8 is a sequence diagram showing timing of operation of each device in a post-rotation operation in the present embodiment. The difference from the first embodiment (FIG. 5) in FIG. 8 is that the charging AC voltage is applied from the charging bias power supply 20 to the charging roller 2 after the primary transfer roller 53 is separated from the intermediate transfer belt 51.

Specifically, after the separation operation of the primary transfer roller 53 is completed, the CPU 120 turns on the application of the charging AC voltage to the charging roller 2 by the charging bias power supply 20. After a predetermined period of time has elapsed since the application of the charging AC voltage is started, the CPU 120 turns on the rotational drive of the development sleeve 42 and turns on the application of the developing DC voltage to the development sleeve 42 by the developing bias power supply 40. Thereafter, the CPU 120 turns on the application of the developing AC voltage at a timing at which the rotational drive of the development sleeve 42 and the developing DC voltage applied to the development sleeve 42 are stabilized, and also turns off the application of the charging AC voltage. Thus, the formation of the toner band on the photosensitive drum 1 is started.

In the present embodiment, the charging AC voltage applied to the charging roller 2 by the charging bias power supply 20 for adjustment of the surface potential of the photosensitive drum 1 is set to, for example, the same voltage as the charging AC voltage applied during the image forming operation. In addition, the time for applying the charging AC voltage to the charging roller 2 (for example, 600 ms) is set in advance so that the surface potential of the photosensitive drum 1 reaches 0V within that time. The developing DC voltage applied from the developing bias power supply 40 to the development sleeve 42 is set so that the development contrast corresponding to the required amount of applied toner can be obtained in accordance with the surface potential (=0V) of the photosensitive drum 1. For example, the developing DC voltage is set to −15V so that a development contrast of 15V can be obtained in accordance with an amount of applied toner of 33 $\mu g/cm^2$ or more.

After starting to form the toner band, similarly to the first embodiment, the CPU 120 turns off the application of the developing AC voltage and the developing DC voltage by the developing bias power supply 40 and the driving of the development sleeve 42 at a timing when a predetermined time has elapsed, thereby terminating the formation of the toner band. In the present embodiment, amount of applied toner (density) of the toner band is changed by changing the developing DC voltage (development contrast), but the density of the toner band may be changed by changing one or more of the duty ratio, the amplitude, and the frequency of the developing AC voltage.

As described above, in the present embodiment, after the primary transfer roller 53 is spaced apart from the intermediate transfer belt 51, the CPU 120 turns on the application of the charging AC voltage to the charging roller 2 by the charging bias power supply 20 in order to adjust the surface potential of the photosensitive drum 1. This makes it possible to realize the formation of the toner band with a more stable amount of applied toner during the post-rotation operation, and makes it possible to suppress the occurrence of streak images.

Third Embodiment

Next, the third embodiment will be described. In the following, description of portions common to the second embodiment will be omitted, and different portions will be mainly described.

In the second embodiment the charging AC voltage for attenuating the surface potential of the photosensitive drum 1 is set to the same voltage as during normal image formation. However, it is desirable that the amplitude of the charging AC voltage applied to the charging roller 2 be set to a small value in order to suppress degradation of the surface of the photosensitive drum 1. In this regard, during normal image formation, the amplitude of the charging AC voltage needs to be set to a relatively large value in order to ensure convergence of the surface potential of the photosensitive drum 1 and reduce unevenness in charging. In contrast, when the above-described toner band is formed, it is possible to ensure potential convergence (to converge the surface potential of the photosensitive drum 1 to 0V).

Therefore, in the present embodiment, before the formation of the toner band at the time of the post-rotation operation, the amplitude of the charging AC voltage applied to the charging roller 2 in order to attenuate the surface potential of the photosensitive drum 1 is set to be smaller than the amplitude of the charging AC voltage applied at the time of image formation. At that time, the peak-to-peak voltage (Vpp) of the charging AC voltage is determined within a range in which an effect of destaticizing the photosensitive drum 1 does not drop. For example, in an environment where the temperature is 30° C. and the humidity is 80%, the Vpp of the charging AC voltage at the time of normal image formation is set to 1400V, while the Vpp of the charging AC voltage is set to 1300V before the formation of the toner band at the time of the post-rotation operation.

In the present embodiment, the CPU 120 sets the amplitude of the AC voltage (the charging AC voltage) applied to the charging roller 2 by the charging bias power supply 20 to adjust the surface potential of the photosensitive drum 1 to be smaller than the amplitude at the time of the image forming operation. By virtue of the present embodiment, even when the charging AC voltage thus set is used, it is possible to cause the surface potential of the photosensitive drum 1 to converge at a sufficiently low value (e.g., 0 V) before the start of formation of the toner band. This makes it possible to realize the formation of a toner band with a more stable amount of applied toner during the post-rotation operation, and makes it possible to suppress the occurrence of streak images.

Fourth Embodiment

Next, the fourth embodiment will be described. In the following, description of portions common to the first embodiment will be omitted, and different portions will be mainly described.

In the first to third embodiments, the development contrast is set so that a required amount of applied toner (e.g., 33 μg/cm$^2$ or more) is ensured for the toner band formed on the photosensitive drum 1 during the post-rotation operation. However, if the density or the amount of electrical charge of the toner in the developing container 41 fluctuates, there is a possibility that amount of applied toner (density) of the toner band will fluctuate.

Therefore, in the present embodiment, an example will be described in which the density of the toner image developed by the developing device 4 (4*a*, 4*b*, 4*c*, 4*d*) is detected and the development contrast (developing DC voltage) used for forming the toner band during the post-rotation operation is changed based on the detection result.

As described above, the developer is supplied from a toner container (not shown) containing the developer to the developing container 41 by a toner supply device (not shown). In the developing container 41, the toner and the carrier are conveyed while being agitated. When the toner in the developer is consumed by the developing operation of the developing device 4, the toner densities of the developer in the developing container 41 gradually decreases. The toner density in the developing container 41 is detected by a sensor (not shown) such as a magnetic permeability sensor provided in the developing container 41. When a decrease in toner density is detected, the developer is replenished from the toner container into the developing container 41. As described above, the toner density in the developing container 41 may vary depending on the consumption of the toner.

In this embodiment, the CPU 120 forms a toner image for inspection (patch image) on the photosensitive drum 1*a* and acquires the density value detected by the density sensor 90 of the toner image for inspection transferred to the intermediate transfer belt 51 by the primary transfer roller 53. At that time, the electrostatic latent image corresponding to the patch image formed on the photosensitive drum 1*a* is developed by the developing device 4 (the development sleeve 42) under a predetermined developing condition. The CPU 120 further sets the development contrast by setting the voltage (developing DC voltage) of the DC component of the developing bias power supply to be applied to the development sleeve 42 by the developing bias power supply 40 for forming the toner band during the post-rotation operation according to the acquired density value.

Specifically, the CPU 120 receives a signal indicating the detection result of the density of the patch image outputted from the density sensor 90, and compares the density value indicated by the signal with a reference value stored in advance in the ROM 122. The CPU 120 obtains a difference value ΔDens between the density value and the reference value, and changes the set value of the development contrast in accordance with ΔDens.

Figure 9A:
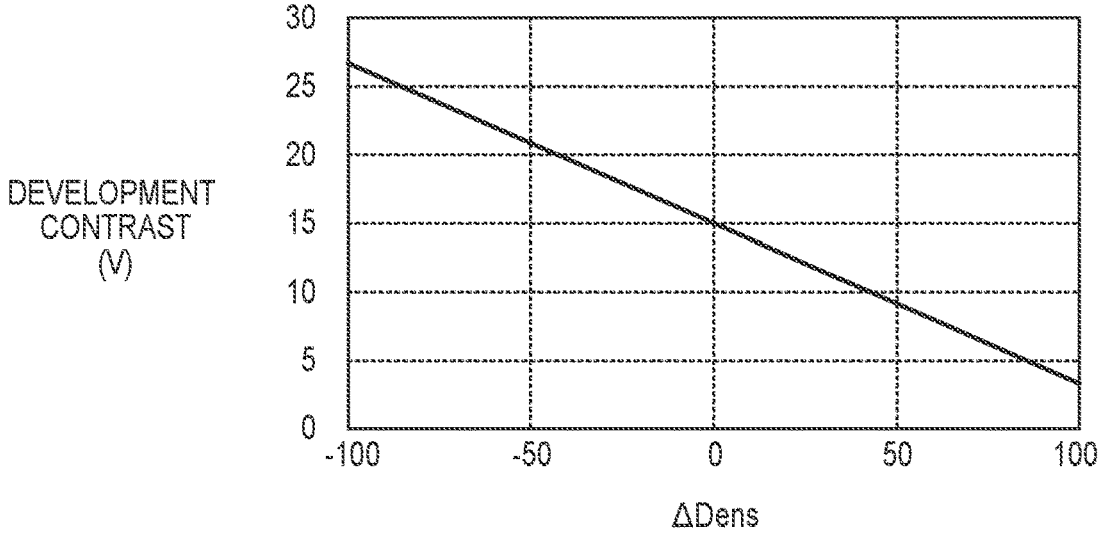
FIGS. 9A to 9C show explanatory diagrams of development contrast setting examples.

FIG. 9A shows an example of correspondence between a detection result (ΔDens) of density of a patch image and development contrast. This correspondence is stored in advance in the ROM 122, for example. When it is sufficient to ensure a predetermined amount of applied toner (e.g., 33 μg/cm$^2$) or more with respect to the toner band, as shown in FIG. 9A, the development contrast can be lowered as ΔDens increases (i.e., as the density of the patch image increases). On the other hand, the smaller ΔDens is (that is, as the lower the density of the patch image is), the more necessary it is to increase the development contrast in order to ensure a predetermined amount of applied toner or more.

The CPU 120 acquires the development contrast corresponding to the difference value ΔDens obtained as described above based on the correspondence relationship exemplified in FIG. 9A stored in the ROM 122. Thus, the CPU 120 sets the development contrast (developing DC voltage) used for forming the toner band during the post-rotation operation. In this manner, by changing the development contrast (developing DC voltage) in accordance with ΔDens, it is possible to realize the formation of the toner band with a stable amount of applied toner regardless of the density and the amount of electrical charge of the toner in the developing container 41. This makes it possible to suppress the occurrence of streak images.

In the present embodiment, an example of changing the developing DC voltage (development contrast) in accordance with ΔDens has been described, but one or more of the duty ratio, the amplitude, and the frequency of the developing AC voltage may be changed in accordance with ΔDens.

Fifth Embodiment

Next, the fifth embodiment will be described. In the following, description of portions common to the fourth embodiment will be omitted, and different portions will be mainly described.

In the first to fourth embodiments, the development contrast (developing DC voltage) is set so that a required amount of applied toner (e.g., 33 μg/cm$^2$ or more) is ensured for the toner band formed on the photosensitive drum 1 during the post-rotation operation. The setting value of the amount of applied toner that is required to suppress the occurrence of a streak image described above varies according to the contact pressure of the drum cleaner 6*a* (the cleaning blade 61) with respect to the photosensitive drum 1*a*. If the contact pressure is reduced, the frictional force between the photosensitive drum 1 and the cleaning blade 61 is reduced, so that the amount of applied toner required in the toner band is reduced in order to suppress the occurrence of a streak image. This leads to a reduction in the toner consumption for forming a toner band.

Therefore, in the fifth embodiment, the contact pressure of the drum cleaner 6*a* (the cleaning blade 61) with respect to the photosensitive drum 1*a* is measured in advance, and the measurement value is stored in the ROM 122. Based on the measurement values stored in the ROM 122, the CPU 120 sets (changes) the development contrast (developing DC voltage) used to form the toner band during the post-rotation operation.

Figure 9B:
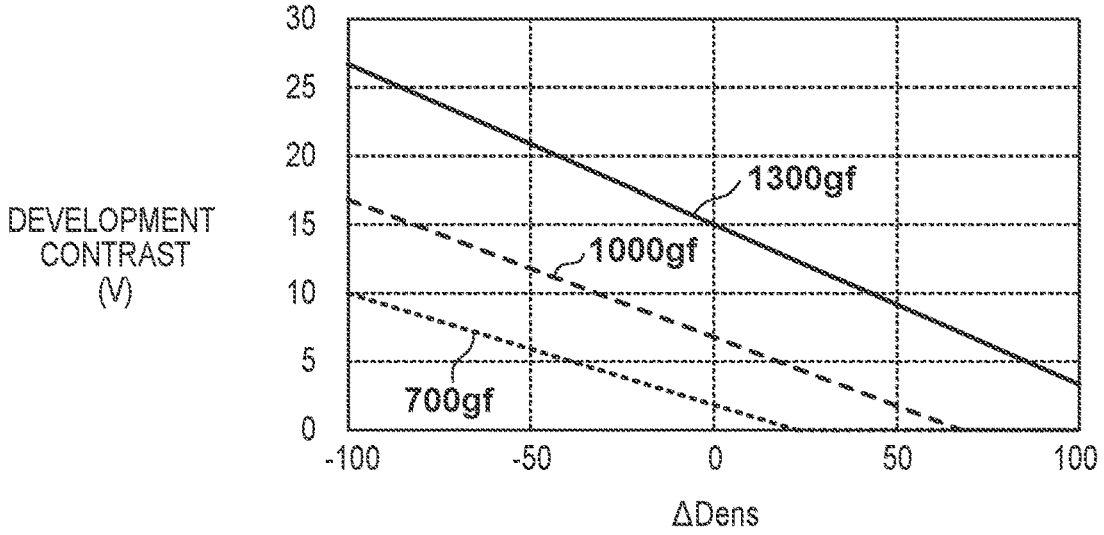

FIG. 9B shows an example of the correspondence between the detection result (ΔDens) of the density of the patch image and the development contrast in cases of different contact pressures (for example, 1300 gf, 1000 gf, and 700 gf). This correspondence is stored in advance in the ROM 122, for example. Incidentally, the correspondence between ΔDens and the development contrast for the contact pressure different from the contact pressure shown in FIG. 9B (characteristic), for example, may be obtained by linear interpolation of the characteristics shown in FIG. 9B. As shown in FIG. 9B, the lower the contact pressure, the lower the amount of applied toner needed for the toner band, so that the development contrast can be lowered (the amount of applied toner can be reduced). Meanwhile, the higher the contact pressure, the higher the amount of applied toner required for in the toner band, so it becomes necessary to raise the development contrast (increase the amount of applied toner).

In the present embodiment, the CPU 120 sets the voltage (developing DC voltage) of the DC component of the bias voltage applied to the development sleeve 42 by the developing bias power supply 40 for forming the toner band in accordance with the contact pressure of the cleaning blade 61) with respect to the photosensitive drum 1*a*. As a result, the development contrast is set (changed). For example, the CPU 120 may acquire the development contrasts corresponding to the detection result (ΔDens) of the density of the patch image and the aforementioned contact pressure, based on the correspondence stored in the ROM 122 and exemplified in FIG. 9B. By setting the development contrast in this way, it is possible to suppress the occurrence of the streak image while reducing the toner consumption for forming the toner band.

In the present embodiment, an example has been described in which the developing DC voltage (development contrast) is changed according to the contact pressure of the drum cleaner 6*a* with respect to the photosensitive drum 1*a*, but one or more of the duty ratio, the amplitude, and the frequency of the developing AC voltage may be changed according to the contact pressure.

Sixth Embodiment

Next, the sixth embodiment will be described. In the following, description of portions common to the first embodiment will be omitted, and different portions will be mainly described.

In the first to fifth embodiments, under certain environmental conditions (for example, a temperature of 30° C. and a humidity of 80%), the amount of applied toner necessary for forming a toner band during a post-rotation operation is determined, and a development contrast (a developing DC voltage) corresponding to the amount of applied toner is set. In this regard, compared to a high humidity environment, the frictional force between the photosensitive drum 1 and the cleaning blade 61 tends to decrease in a low humidity environment. In this case, the amount of applied toner required for the toner band is reduced in order to suppress the occurrence of a streak image. This leads to a reduction in the toner consumption for forming a toner band.

Therefore, in the sixth embodiment, in accordance with the temperature and humidity detected by the temperature/humidity sensor 130 in the environment in which the image forming apparatus 100 is installed, the development contrast (developing DC voltage) used for forming a toner band during the post-rotation operation is set (changed). This leads to a reduction in the toner consumption for forming a toner band.

Figure 9C:
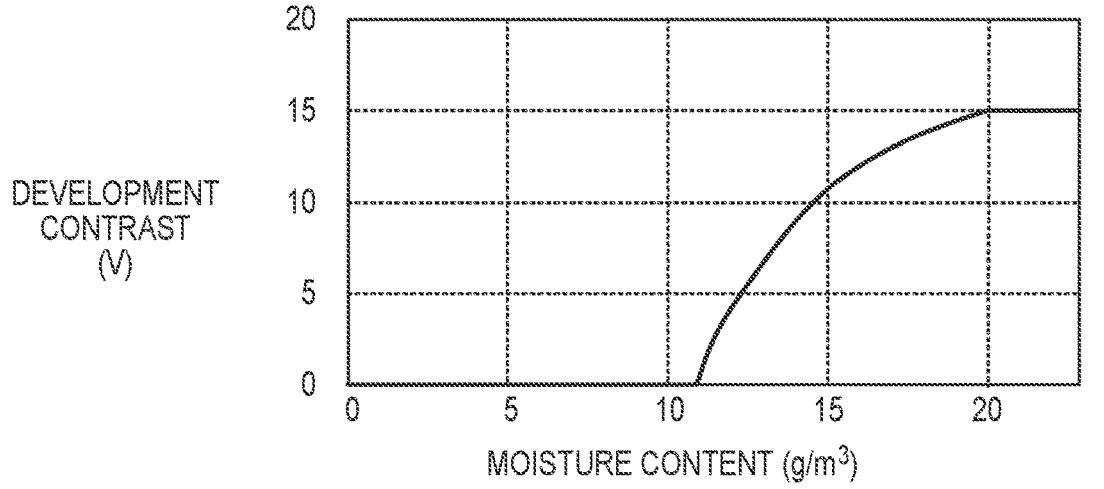

FIG. 9C shows an example of the correspondence between the moisture content (g/m3) in the air of the environment where the image forming apparatus 100 is installed and the development contrast. In the example of FIG. 9C, it is assumed that the contact pressure of the drum cleaner 6*a* with respect to the photosensitive drum 1*a* is 1300 gf and ΔDens=0. The CPU 120 measures the moisture content in the air based on the output signal of the temperature/humidity sensor 130, for example, prior to starting to execute image forming. The temperature/humidity sensor 130 outputs, for example, a value indicating the temperature and the relative humidity. In this instance, the CPU 120 measures the moisture content in the air based on the temperature and the relative humidity indicated by the output signals of the temperature/humidity sensor 130.

The CPU 120 sets (changes) the development contrast (developing DC voltage) used to form the toner band during the post-rotation operation in accordance with the measurement value of the moisture content in the air obtained by using the temperature/humidity sensor 130. Specifically, the CPU 120 acquires the development contrast corresponding to a measurement value of the moisture content in the air based on the correspondence stored in the ROM 122 and exemplified in FIG. 9B, thereby setting the development contrast (developing DC voltage). For example, the development contrast (developing DC voltage) is lowered in accordance with a decrease in the moisture content in the air. By this, it is possible to suppress the occurrence of the streak image while reducing the toner consumption for forming the toner band in accordance with the moisture content in the air.

In the present embodiment, an example of changing the developing DC voltage (development contrast) in accordance with the moisture content in the air has been described, but one or more of the duty ratio, the amplitude, and the frequency of the developing AC voltage may be changed in accordance with the moisture content in the air. In addition, for example, when the measurement value of the moisture content in the air falls below a predetermined threshold value (that is, when the amount of applied toner that is required is relatively small), control to stop the toner band formation process itself may be performed.

Incidentally, in the present embodiment, a case where, after the image formation is completed, the primary transfer roller 53 of each of the image forming stations Sa to Sd is separated from the intermediate transfer belt 51 and thereafter a toner band is formed has been described, but the present invention is not limited thereto. For example, configuration may also be taken such that the primary transfer roller 53 of the image forming stations Sa to Sc other than black are separated from the intermediate transfer belt 51, and the primary transfer roller 53 of the black image forming station Sd are not separated from the intermediate transfer belt 51. In this case, in the black image forming station Sd, a part of the toner band may adhere to the intermediate transfer belt 51 when the toner band passes through the primary transfer nip, but the amount of toner adhering to the intermediate transfer belt 51 can be reduced as compared with the case where the toner band is formed without separating the primary transfer rollers 53 of all the image forming stations Sa to Sd from the intermediate transfer belt 51. Therefore, it is possible to suppress the amount of adhered toner from the intermediate transfer belt 51 to the secondary transfer outer roller 57, and it is possible to suppress the occurrence of fouling on the back side on the recording material.

In each of the above-described embodiments, although control in which the rotation of the photosensitive drum 1 is caused to stop such that the entire area of the toner band formed on the photosensitive drum 1 stops within a section from a position facing the primary transfer roller 53 to a position facing the cleaning blade 61 is performed, each embodiment is not limited to this. For example, control in which the rotation of the photosensitive drum 1 is caused to stop such that at least a part of the toner band formed on the photosensitive drum 1 stops within the section from the position facing the primary transfer roller 53 to the position facing the cleaning blade 61 may be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-193759, filed Nov. 20, 2020, which is hereby incorporated by reference herein in its entirety.

What is claimed is:

1. An image forming apparatus, comprising:

an image carrier that is driven to rotate;

a developing device configured to form, with toner, a toner image by developing an electrostatic latent image formed on the image carrier;

an intermediate transfer member to which a toner image that is to be transferred to a recording material is transferred from the image carrier;

a transfer roller capable of switching between a state of contact with the intermediate transfer member and a state of separation from the intermediate transfer member, and configured to transfer a toner image on the image carrier to the intermediate transfer member in the state of contact with the intermediate transfer member;

a cleaning blade disposed on a downstream side of the transfer roller in a rotation direction in which the image carrier rotates, and configured to remove toner that remains on the image carrier after transfer of a toner image to the intermediate transfer member; and a controller configured to, after completion of an image forming operation for forming an image on a recording material, cause the transfer roller to separate from the intermediate transfer member, cause the developing device to form on the image carrier a toner band to be supplied to the cleaning blade, and cause rotation of the image carrier to stop such that at least a part of the toner band formed on the image carrier stops within a section from a first position facing the transfer roller to a second position facing the cleaning blade in the rotation direction.

2. The image forming apparatus according to claim 1, wherein the controller causes the rotation of the image carrier to stop before a rear end of the toner band formed on the image carrier passes the second position after passing the first position.

3. The image forming apparatus according to claim 1, wherein the controller causes the toner band to be formed on the image carrier during execution of a post-rotation operation for causing the rotation of the image carrier to continue after completion of the image forming operation.

4. The image forming apparatus according to claim 1, further comprising:

a charging roller configured to charge a surface of the image carrier;

a first bias application unit configured to apply a bias voltage in which an AC voltage is superimposed on a DC voltage, to the charging roller at a time of execution of the image forming operation; and a second bias application unit configured to apply a bias voltage in which an AC voltage is superimposed on a DC voltage, to the developing device at a time of execution of the image forming operation, wherein after completion of the image forming operation, the controller turns off application of the bias voltages by the first bias application unit and the second bias application unit, and after causing the transfer roller to separate from the intermediate transfer member, turns on application of the bias voltage by the second bias application unit so as to cause the developing device to form the toner band on the image carrier.

5. The image forming apparatus according to claim 4, further comprising a pre-exposure unit arranged between the cleaning blade and the charging roller in the rotation direction, and configured to, before charging by the charging roller is performed, perform, in relation to the image carrier, a pre-exposure for removing an electric charge that remains on the image carrier, wherein the controller causes the developing device to form the toner band on the image carrier by turning on application of the bias voltage by the second bias application unit in a state in which the pre-exposure by the pre-exposure unit is caused to continue after completion of the image forming operation.

6. The image forming apparatus according to claim 5, wherein the controller sets a voltage of a DC component of the bias voltage that the second bias application unit applies to the developing device in order to form the toner band, based on an amount of applied toner necessary for the toner band.

7. The image forming apparatus according to claim 5, wherein the controller, after causing the transfer roller to separate from the intermediate transfer member, turns on application of AC voltage to the charging roller by the first bias application unit in order to adjust a surface potential of the image carrier.

8. The image forming apparatus according to claim 7, wherein the controller sets an AC voltage that the first bias application unit applies to the charging roller in order to adjust the surface potential of the image carrier, to be the same voltage as the AC voltage applied at the time of the image forming operation.

9. The image forming apparatus according to claim 7, wherein the controller sets an amplitude of an AC voltage that the first bias application unit applies to the charging roller in order to adjust the surface potential of the image carrier, to be a smaller amplitude than at the time of the image forming operation.

10. The image forming apparatus according to claim 6, further comprising a detection unit configured to detect a density of a toner image transferred to the intermediate transfer member, wherein the controller causes a toner image for inspection to be formed on the image carrier, and in accordance with a density value, detected by the detection unit, of the toner image for inspection transferred to the intermediate transfer member by the transfer roller, sets a voltage of a DC component of the bias voltage that the second bias application unit applies to the developing device in order to form the toner band.

11. The image forming apparatus according to claim 10, wherein the controller, in accordance with a difference between the density value detected by the detection unit and a reference value, sets a voltage of a DC component of the bias voltage that the second bias application unit applies to the developing device in order to form the toner band.

12. The image forming apparatus according to claim 6, further comprising a storage unit configured to store a measurement value of contact pressure in relation to the image carrier by the cleaning blade, wherein the controller, in accordance with the measurement value stored in the storage unit, sets a voltage of a DC component of the bias voltage that the second bias application unit applies to the developing device in order to form the toner band.

13. The image forming apparatus according to claim 6, further comprising a detection unit configured to detect a temperature and a humidity where the image forming apparatus is installed, wherein the controller, in accordance with the temperature and the humidity detected by the detection unit, sets a voltage of a DC component of the bias voltage that the second bias application unit applies to the developing device in order to form the toner band.

14. The image forming apparatus according to claim 13, wherein the controller measures moisture content in the air based on the temperature and humidity detected by the detection unit, and in accordance with a measurement value of the moisture content, sets the voltage of the DC component of the bias voltage that the second bias application unit applies to the developing device in order to form the toner band.

* * * * *